US005732918A

United States Patent [19]

Steele et al.

[11] Patent Number: 5,732,918

[45] Date of Patent: Mar. 31, 1998

[54] ROOF CATCHBOARD BRACKET

[76] Inventors: Thomas C. Steele, 7231 N. 173rd Ave., Waddell, Ariz. 85355; Kevin R. Schuck, Jack Burden Rd., Wickenburg, Ariz. 85358; John M. Denny, 6801 W. Surrey, Peoria, Ariz. 85381

[21] Appl. No.: 681,650

[22] Filed: Jul. 29, 1996

[51] Int. Cl.[6] ..... A47G 29/02

[52] U.S. Cl. ..... 248/237; 248/300

[58] Field of Search ..... 248/237, 48.1, 248/148, 201, 247, 300

[56] References Cited

U.S. PATENT DOCUMENTS

| | | | |
|---|---|---|---|
| 1,159,372 | 11/1915 | Goff | 248/237 |
| 2,496,556 | 2/1950 | Nelson | 248/237 |
| 4,382,416 | 5/1983 | Kellogg-Smith | 114/90 |
| 4,884,775 | 12/1989 | Fischer, Jr. | 248/237 |
| 4,946,123 | 8/1990 | Albert | 248/237 |
| 5,098,093 | 3/1992 | Dupré | 248/237 |
| 5,113,971 | 5/1992 | Violet | 248/237 |
| 5,165,642 | 11/1992 | Rihaly | 248/237 |
| 5,195,710 | 3/1993 | Remblier | 248/201 |
| 5,513,826 | 5/1996 | Lebaron | 248/237 |

*Primary Examiner*—Leslie A. Braun
*Assistant Examiner*—Anita M. King
*Attorney, Agent, or Firm*—Brown Raysman Millstein Felder & Steiner LLP

[57] ABSTRACT

A roof catchboard bracket for securing a catchboard to a roof, preferably formed from a plastic material. The device includes an L-shaped bracket having a first leg adapted to be removably secured to a roof and a second leg adapted to be removably secured to a catchboard. An integrally formed brace portion extends intermediate the first and second legs for bracing the second leg against the first leg. Other features include a provision for nesting a plurality of such brackets one on top of the other, and pry chamfers which allow the brackets to be readily removed after nailing to a roof surface.

15 Claims, 6 Drawing Sheets

62
50
63
25a
25
500
51
x
y
11
60
20
61
70
40b
74
40
71
40a
72
h

ROOF CATCHBOARD BRACKET

CROSS-REFERENCE TO RELATED PROVISIONAL APPLICATION

This application claims the benefit of U.S. Provisional Application No. 60/001,683 filed on Jul. 31, 1995.

BACKGROUND OF THE INVENTION

The present invention relates generally to a roof catchboard bracket and, in particular, to a roof catchboard bracket formed from a plastic material that can be easily secured to and removed from a roof surface, can be easily nested with other similar roof brackets and can be easily and inexpensively manufactured while providing the support necessary on roof construction sites.

Roof bracket devices have been developed over the years for the purpose of supporting scaffolding boards or the like on a slanted roof surface to prevent a worker on the roof or construction supplies from sliding off of the roof and to otherwise prevent accidents usually associated with working on an elevated inclined roof surface. Indeed, OSHA (the Occupational Safety and Health Agency) has specific requirements regarding safety in roof construction situations.

Prior art roof bracket devices have characteristically been comprised of a steel bracket construction. U.S. Pat. No. 4,946,123 to Albert describes a steel roof bracket which includes a flat arm to be nailed to a roof truss, a flat crosspiece extending transversely to the arm in the plane thereof, and a support extending upwardly from the end of the arm for supporting a plank or the like resting on the flat crosspiece. U.S. Pat. No. 5,113,971 to Violet describes an adjustable steel roofing jack for securing a scaffold board to a roof. U.S. Pat. No. 5,165,642 to Rihaly describes a shingle holder which is secured to the slanted surface of a roof to hold a supply of shingles.

Heretofore, roof brackets have in some cases been poorly supported or supportable on the roof, resulting in the possibility that a significant amount of force against the catchboard could damage or break the bracket. For example, U.S. Pat. No. 4,884,775 to Fischer, Jr. describes an adjustable roof bracket which includes an adjustment portion for adjusting the angle of the upright support portion relative to the roof to provide appropriate support. However, the use of moving or adjustable parts in such construction makes it susceptible to damage or improper support.

Accordingly, it can be seen that heretofore an acceptable, reliable and simple one-piece roof bracket has not been provided. The present invention provides such a roof catchboard bracket which can be easily secured to and removed from a roof surface while providing substantial support to a catchboard. Such an improved roof catchboard bracket is extremely desirable.

SUMMARY OF THE INVENTION

Generally speaking, in accordance with the present invention, a roof catchboard bracket for supporting a catchboard on a roof surface is provided. The roof catchboard bracket is preferably molded from a plastic material and includes a generally L-shaped bracket having a first leg which is removably securable to a roof surface and a second upstanding leg which receives a catchboard thereagainst. An integrally formed brace system braces the second leg against the first leg to maintain the second leg in its upstanding position when a force is applied against the second leg.

In a preferred embodiment, the roof catchboard bracket is constructed to be stacked with like roof catchboard brackets during shipping to achieve nesting of the roof catchboard brackets of the invention. The roof catchboard bracket may also include a pull tab opening to allow finger purchase to disengage successively nested roof catchboard brackets.

In addition, the first leg of the roof catchboard bracket, which is secured to a roof surface when in use, may include a recessed or chamfer area to permit a pry bar, hammer or the like, to be inserted to allow easier removal of the brackets from the roof surface.

Both legs of the bracket include openings to permit nails to be nailed therethrough. The present invention may also include protective metal shields that overlie portions of the legs to reinforce the legs and reduce the risk of damage thereto during nailing.

Accordingly, it is an object of the present invention to provide an improved roof catchboard bracket molded from a plastic material which provides the requisite support on a roof surface.

Another object of the present invention is to provide an improved roof catchboard bracket having a construction that permits the nesting of like roof brackets during storage and shipment.

Still another object of the present invention is to provide an improved roof bracket construction that permits workers to apply more force against a catchboard supported by the bracket while still protecting the integrity of the roof catchboard bracket and preventing injury to workers.

Another object of the present invention is to provide an improved roof catchboard bracket that can be more easily removed from the roof structure once secured thereto.

Still other objects and advantages of the invention will in part be obvious and will in part be apparent from the specification.

The invention accordingly comprises the features of construction, combination of elements and arrangement of parts which will be exemplified in the constructions hereinafter set forth in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
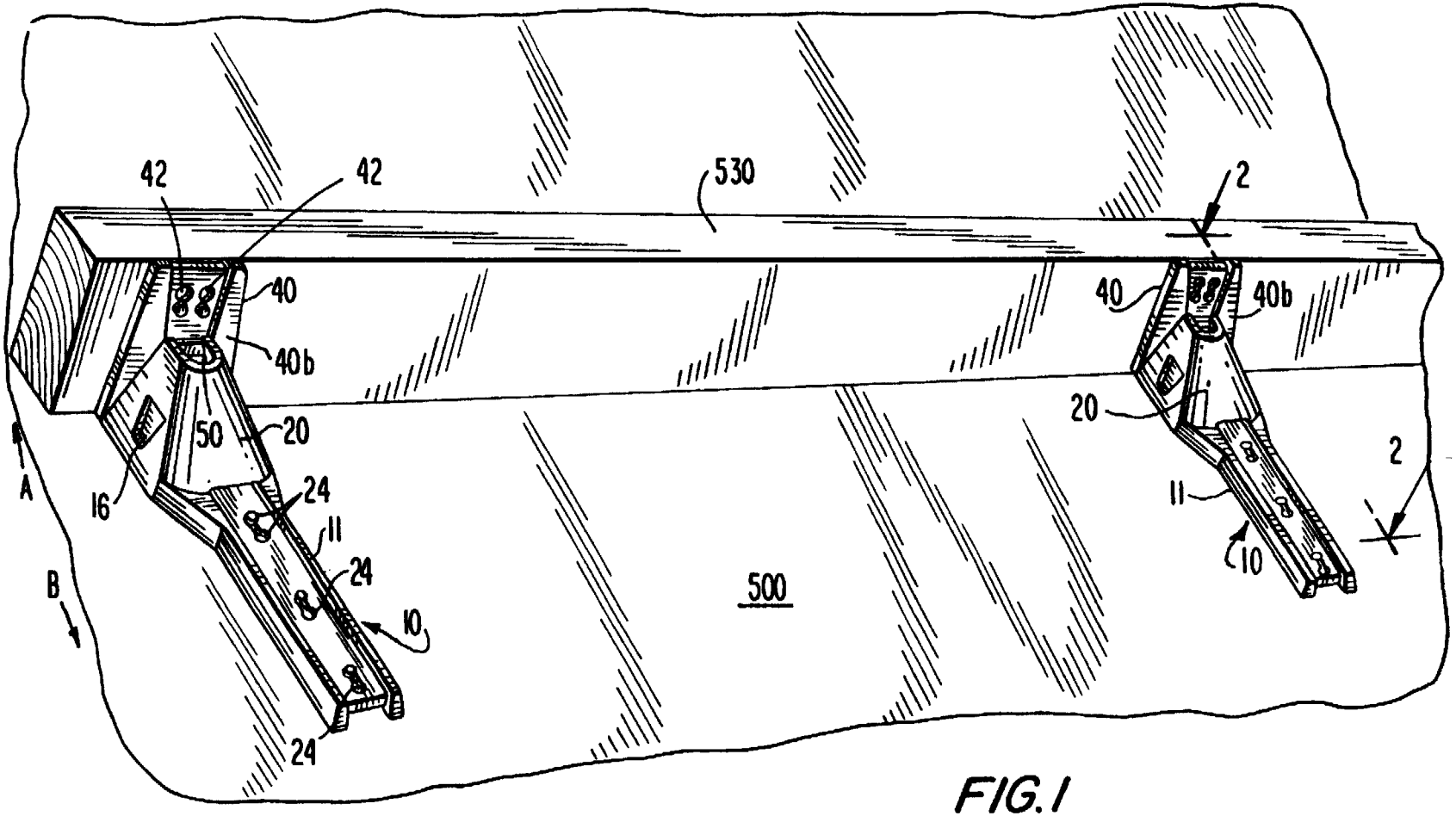
FIG. 1 is a perspective view of two roof catchboard brackets constructed in accordance with a first embodiment of the present invention, shown nailed to a roof surface and having a catchboard secured thereto.
Figure 2:
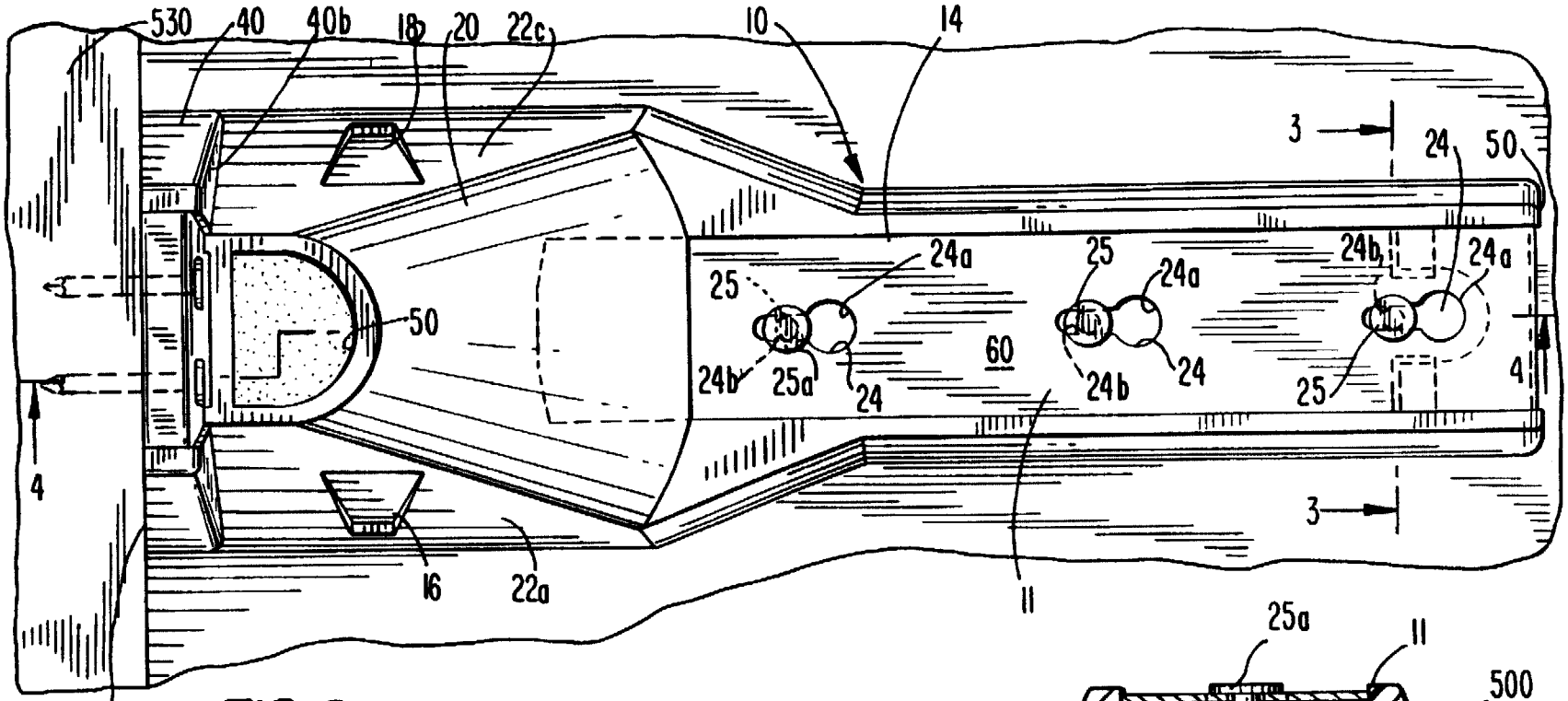
FIG. 2 is an enlarged top plan view of the roof catchboard bracket taken along line 2—2 of FIG. 1.
Figure 3:
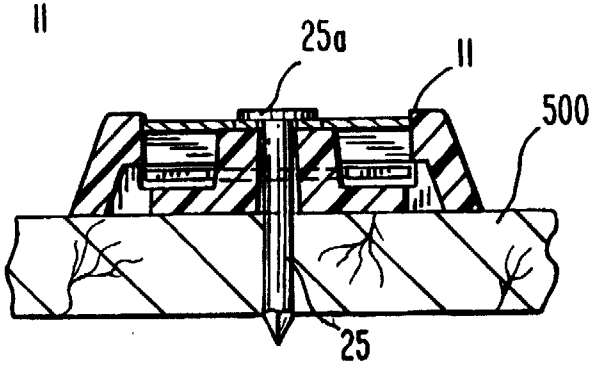
FIG. 3 is a sectional view of the roof catchboard bracket taken along line 3—3 of FIG. 2.

Reference is first made generally to FIG. 1 of the drawings wherein an L-shaped roof catchboard bracket, generally indicated at 10, constructed in accordance with a first embodiment of the present invention, is depicted. FIG. 1 illustrates two L-shaped roof catchboard brackets 10 as secured to a roof 500 by nailing. A catchboard 530 such as a 2×4 board or the like is depicted as having been secured to brackets 10 by nailing.

Reference is now made additionally to FIGS. 2 through 5 which depicts the construction of bracket 10 in greater detail. In the present embodiment, bracket 10 is a one-piece integrally formed molded L-shaped bracket preferably constructed from high density polyethylene, for example, and includes a first leg 11, and a second upstanding leg 40 which extends upwardly from leg 11. A brace portion, generally indicated at 20, braces first leg 11 against second leg 40.

Leg 11 includes an upper surface 14 having a plurality of elongated keyhole shaped openings 24 positioned therealong and each dimensioned to receive a nail 25 having a head 25*a*. Each opening 24 includes an enlarged region 24*a* having a diameter greater than the diameter of head 25*a* of nail 25 and a narrower region 24*b* having a width which is less than the diameter of head 25*a* of nail 25. These keyhole slots allow for easy insertion and removal of bracket 10 from the roof surface. In this way, leg 11 of bracket 10 can be nailed onto the roof through keyhole slots 24 and will remain securely fastened to roof surface 500 until it is desired that bracket 10 be removed therefrom.

Figures 4, 5:
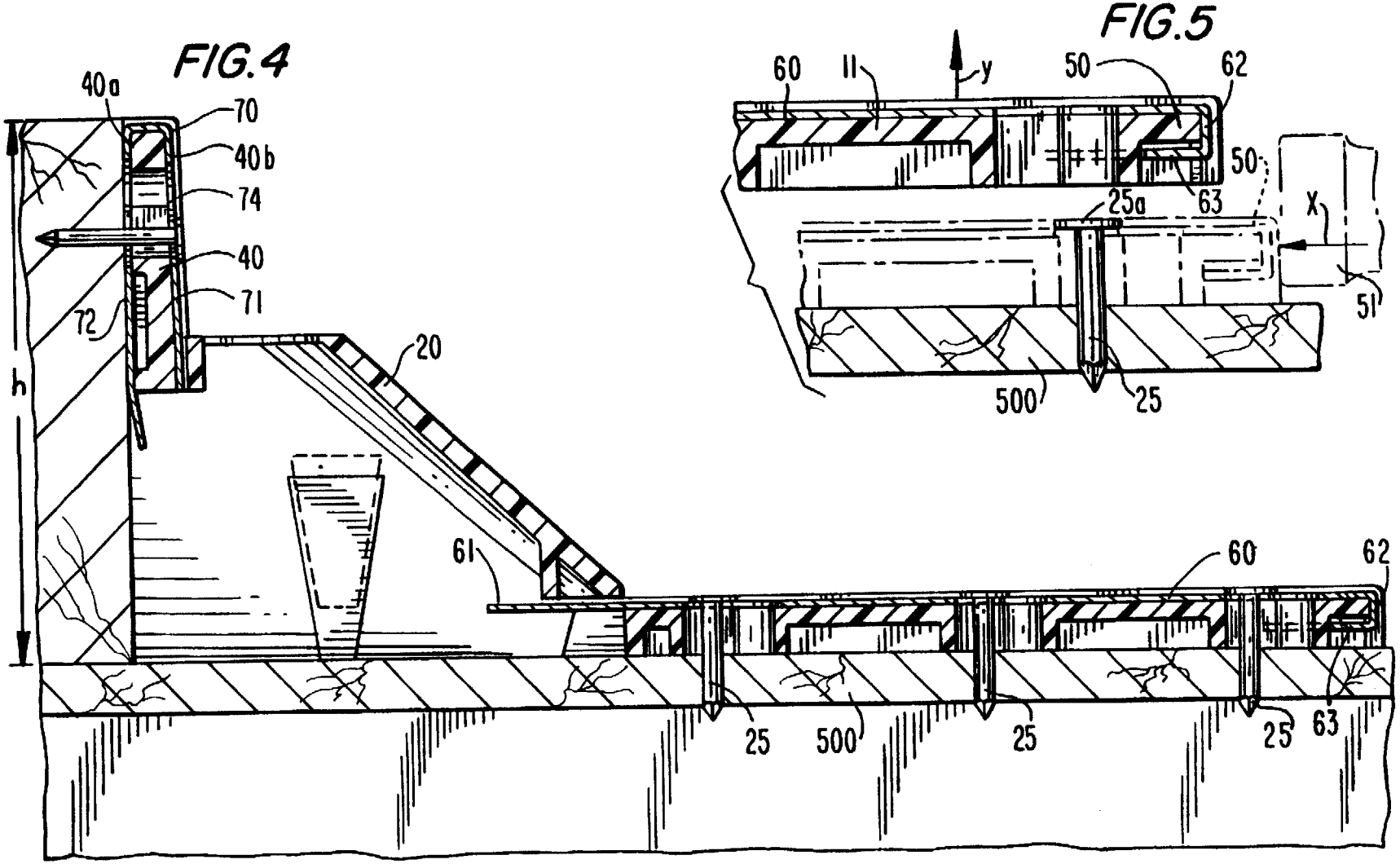
FIG. 4 is a sectional view of the roof catchboard bracket taken along lines 4—4 of FIG. 2.
FIG. 5 is a sectional view of a portion of the roof catchboard bracket of FIG. 4 depicting the motion of a hammer striking the end thereof to illustrate one method of removal of the roof catchboard bracket from the roof surface.

To remove bracket 10 from roof surface 500, a user merely has to strike free end 50 of leg 11 with a hammer 51, a foot or the like in the direction of arrow X, as best illustrated in FIG. 5, to shift bracket 10 from the position shown in phantom in FIG. 5 where nail 25 is within region 24*b* to its released position as shown in FIG. 5 where nail 25 is within enlarged region 24*a* and may be lifted in the direction of arrow Y. In this way, bracket 10 can be easily lifted and removed from roof surface 500.

Second leg 40 includes a front surface 40*a* and a back surface 40*b* which faces first leg 11. Back surface 40*b* abuts against brace position 20 to prevent second leg 40 from being bent towards first leg 11 due to the force exerted by a worker's foot against catchboard 530 when secured to front surface 40*a* of second leg 40.

Second leg 40 includes several nail openings 42. Openings 42 may also be keyhole shaped. In this way, catchboard 530 may be easily secured to surface 40*a* of leg 40 and removed therefrom.

In a preferred embodiment of the presently described construction, the height "h" of second leg 40 (FIG. 4) is between about 5 and 6 inches. This height is desirable to facilitate at least a 2×4 catchboard having a height of about 4 inches. It is also preferred that leg 11 be about 12–13 inches in length and about 2.5 inches in width.

Figure 7:
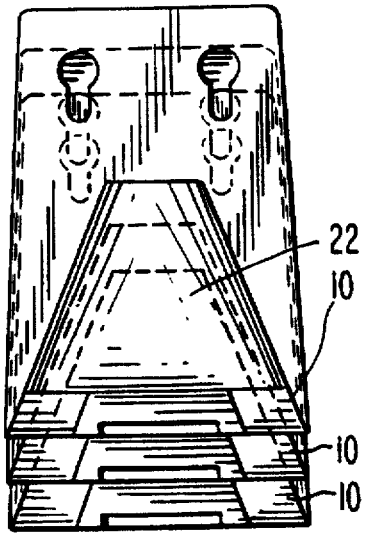
FIG. 7 is a front elevational view of a plurality of roof catchboard brackets of the present invention which have been stacked upon one another.

Brace 20 includes recessed portions 16 and 18 on the side walls 22*a* and 22*c* thereof, respectively, which assist in nesting successively stacked brackets 10 as shown in FIG. 7.

In addition, an aperture 50 is provided at the apex of brace 20 to define a pull tab for a finger purchase to permit a single bracket 10 to be pulled and released from a nested stack of brackets 10.

A thin metal shield 60 preferably formed from galvanized steel may be provided to protect first leg 11 from damage caused primarily during the hammering of nails through openings 24. Shield 60 includes a clip portion 62 at the end thereof to releasably latch over free end 50 of first leg 11. Shield 60 also includes a plurality of keyhole shaped holes which correspond to the shape of, align with and protect the integrity of openings 24 of leg 11.

Shield 60 clips onto foot 14 by placing finger 63 of clip 62 on the underside of leg 14. The biasing of finger 63 against the underside of leg 14 prevents shield 60 from being inadvertently or prematurely removed. Front edge 61 of shield 60 is received in a slot 64 formed intermediate first leg 11 and brace 20.

A second thin metal shield 70 may be provided to protect second leg 40 from damage due to nailing against a catchboard. Shield 70 is U-shaped with a front finger 71 and a rear finger 72 which is slightly longer. Shield 70 includes holes 74 which correspond to the shape of, align with and protect the integrity of keyhole shaped openings 42. Shield 70 clips onto second leg 40 as depicted. The preferred material from which shield 70 is formed is galvanized steel.

Figure 6:
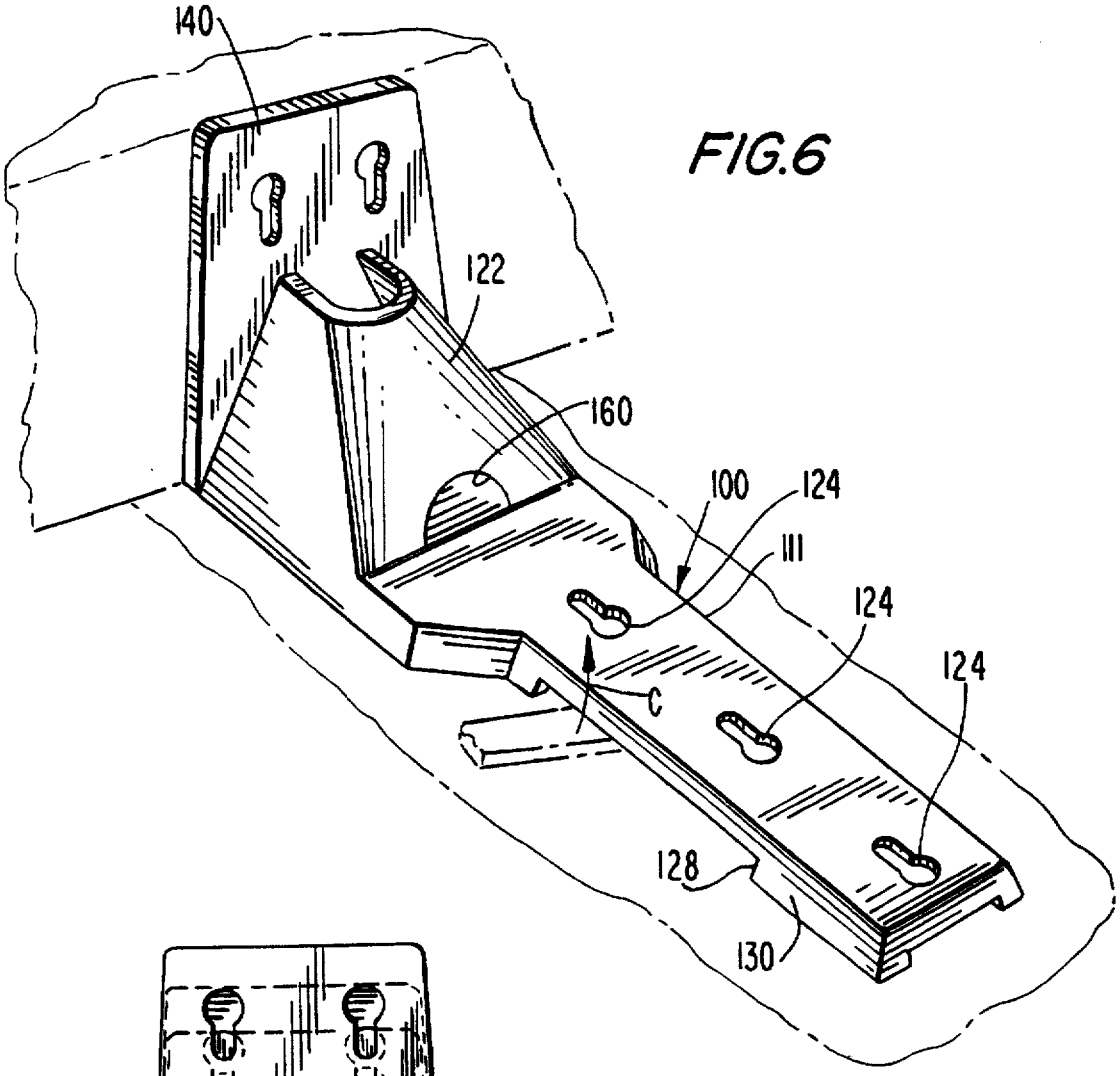
FIG. 6 is a perspective view of a roof catchboard bracket constructed in accordance with a second embodiment of the present invention.

Reference is now made to FIG. 6, wherein a roof catchboard bracket, generally indicated at 100 and constructed in accordance with a second embodiment of the present invention, is depicted. Bracket 100 is constructed similarly to bracket 10 except as hereinafter described in detail.

Similar to bracket 10, bracket 100 is a one-piece L-shaped bracket, preferably formed of high density polyethylene, although it is recognized that other suitable materials may also be used. Bracket 100 also includes a first leg 111, a second leg 140 and a brace 122 therebetween.

Brace 122 may include a hammer relief portion 160 in the form of a concave recess portion which facilitates the striking of a nail inserted in opening 124 closest to brace 122 to prevent damage to brace 122.

Bracket 100 also includes a skirt 130 along the side edges thereof having a raised slot formed as depicted to define a pry chamfer region 128. In a preferred embodiment, pry chamfer region 128 is approximately three inches long. In addition, region 128 extends approximately one-half inch under leg 111 in the widthwise direction. A second pry chamfer region 128 may be formed on the opposite side of leg 111. Pry chamfer region 128 permits bracket 100 to be pried off of the roof surface by a pry bar, hammer or the like.

The use of brackets 10 and 100 will now be described with particular reference being made once again to FIG. 1 which illustrates two roof catchboard brackets nailed and secured to a roof surface.

The roof catchboard brackets of the present invention may either be nailed first to the catchboard and then to the roof with the catchboard attached, or vice versa. Bracket 10 is positioned on an inclined roof surface so that second leg 40 is positioned above first leg 11 such that front surface 40*a* of second leg 40 faces the peak of the roof as indicated by arrow B. Bracket 10 is nailed to the roof surface by inserting a nail through each opening 24 and hammering the nails until bracket 10 is adequately secured to roof surface 500. A typical elongated catchboard will be supported by a plurality of brackets, each constructed in accordance with the present invention, each placed several feet apart.

After each area of the roof surface is complete, the catchboard can be removed by forcing the catchboard upward and out of holes 42. Striking kick plate 50 of bracket 10 (by a hammer as shown in FIG. 5) will then cause bracket 10 to shift to its second position whereby the nailheads can exit from larger region 24*a* of holes 24 on leg 14. The remaining extended nails may be hammered flush into the roof surface so as not to leave any holes therein, or may be removed altogether. The roof catchboard brackets can then be moved to another location on the roof surface where needed.

The use of the pry chamfer region 128 on alternate brackets 100 also permits the removal of bracket 100 from roof surface 500 by placing a device, such as a wedge, pry bar, hammer or the like under one or more pry chamfer regions 128. Pulling upward and away from the roof surface as indicated by arrow C in FIG. 6 will cause bracket 100 to disengage from roof surface 500. The nails which were previously secured within holes 124 can then be reinserted if desired into the holes left by bracket 100 in roof surface 500 and hammered flush against roof surface 500.

FIG. 7 depicts a plurality of brackets, constructed in accordance with either the first or second embodiments of the present invention, stacked or nested, upon one another. It will be appreciated from the following disclosure that the improved roof catchboard bracket, constructed in accordance with either the first or second embodiments of the present invention, can easily be removed from one another.

Brace 22 or 122 of bracket 10 or 100, respectively, is constructed to receive the underside of each successive shell 22 (122) of each respective successive bracket 10 or 100, allowing the nesting of successive brackets. In addition, each recessed region 16 and 18 of the brackets receives each successive respective recessed region 16 and 18 of successive shells and assist in securing each successive nested bracket. To remove a bracket from the nested group, one can merely pull the bracket, grabbing from pull tab 50 at the apex of shell 22 (122). This ensures easy removal of successively nested brackets.

Figure 8:
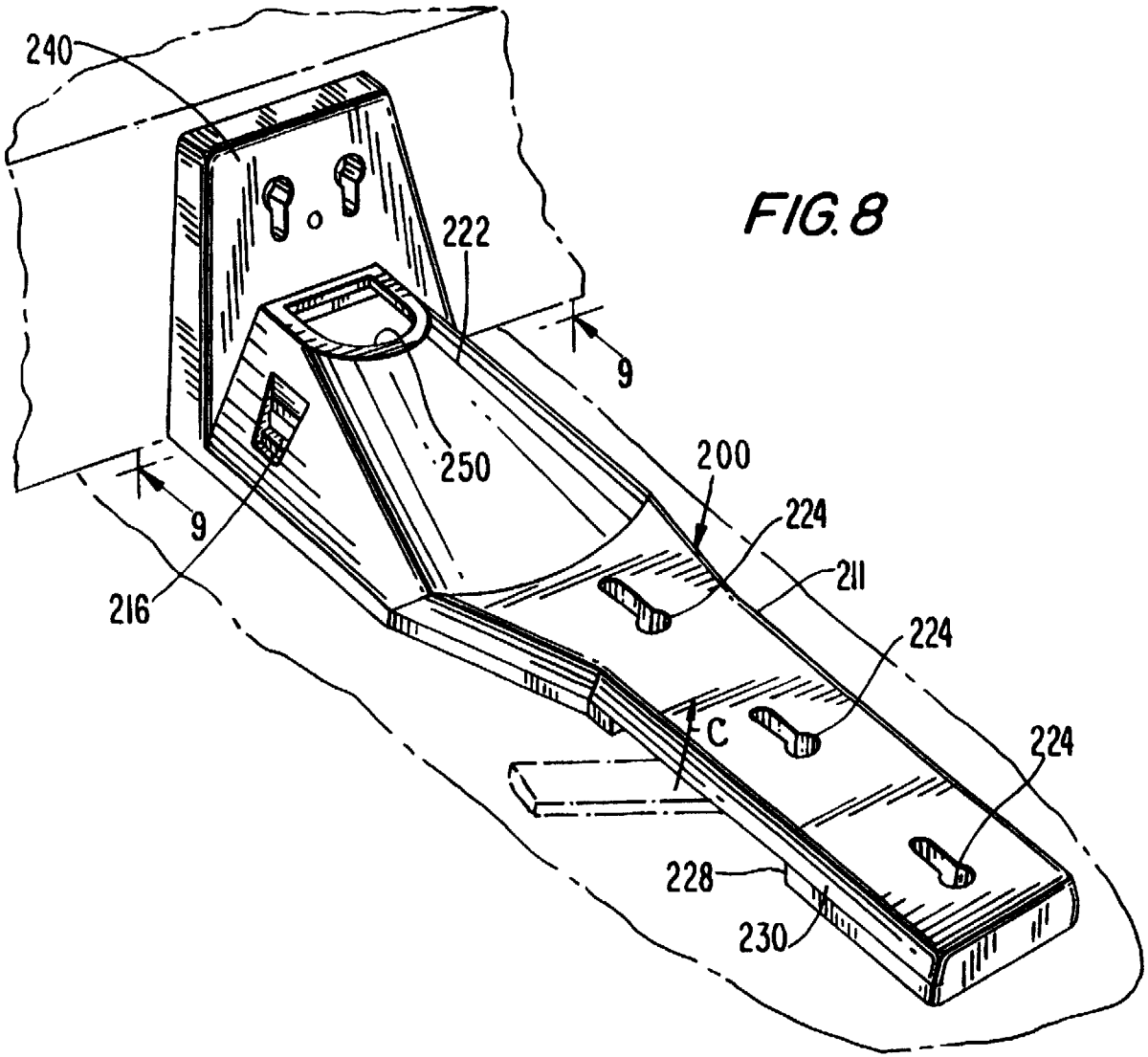
FIG. 8 is a perspective of a roof catchboard bracket constructed in accordance with a preferred embodiment of the present invention.

Reference is now made to FIG. 8 of the drawings which depicts the present, preferred embodiment of the present invention. Reference numbers used in FIG. 8 where related to components depicted in the roof catchboard brackets in earlier Figures are now numbered in the corresponding 200 number series. Bracket 200 is a one-piece integrally formed and molded L-shaped bracket preferably constructed from a polycarbonate plastic resin material. Since polycarbonate plastic resin is an extremely strong plastic, it will function exceptionally well as the material used for forming a roof catchboard bracket in accordance with the present invention. However, since such plastic material is solvent sensitive and may crack when coming in contact with hydrocarbons, it is important that an appropriate warning be placed on or in connection with the bracket to avoid exposure to hydrocarbon materials.

Bracket 200 includes an elongated first leg 211 and a second upstanding leg 240, with an intermediate brace portion 222 therebetween which acts to brace second leg 240 against first leg 211 to withstand the normal pressures to be exerted thereon as workers apply force against the 2×4 catchboard to be attached or secured thereto. Like the earlier embodiments, first leg 211 includes keyhole nail slots 224, as depicted, and second leg 240 includes corresponding keyhole nail slots, as depicted.

Bracket 200 also includes a skirt 230 and pry chamfer regions 228 on opposite sides thereof and an aperture 250 at the apex of brace 222 which defines a pull tab for a finger purchase to permit nested brackets to be pulled and released from a nested stack of brackets 200.

Figure 9:
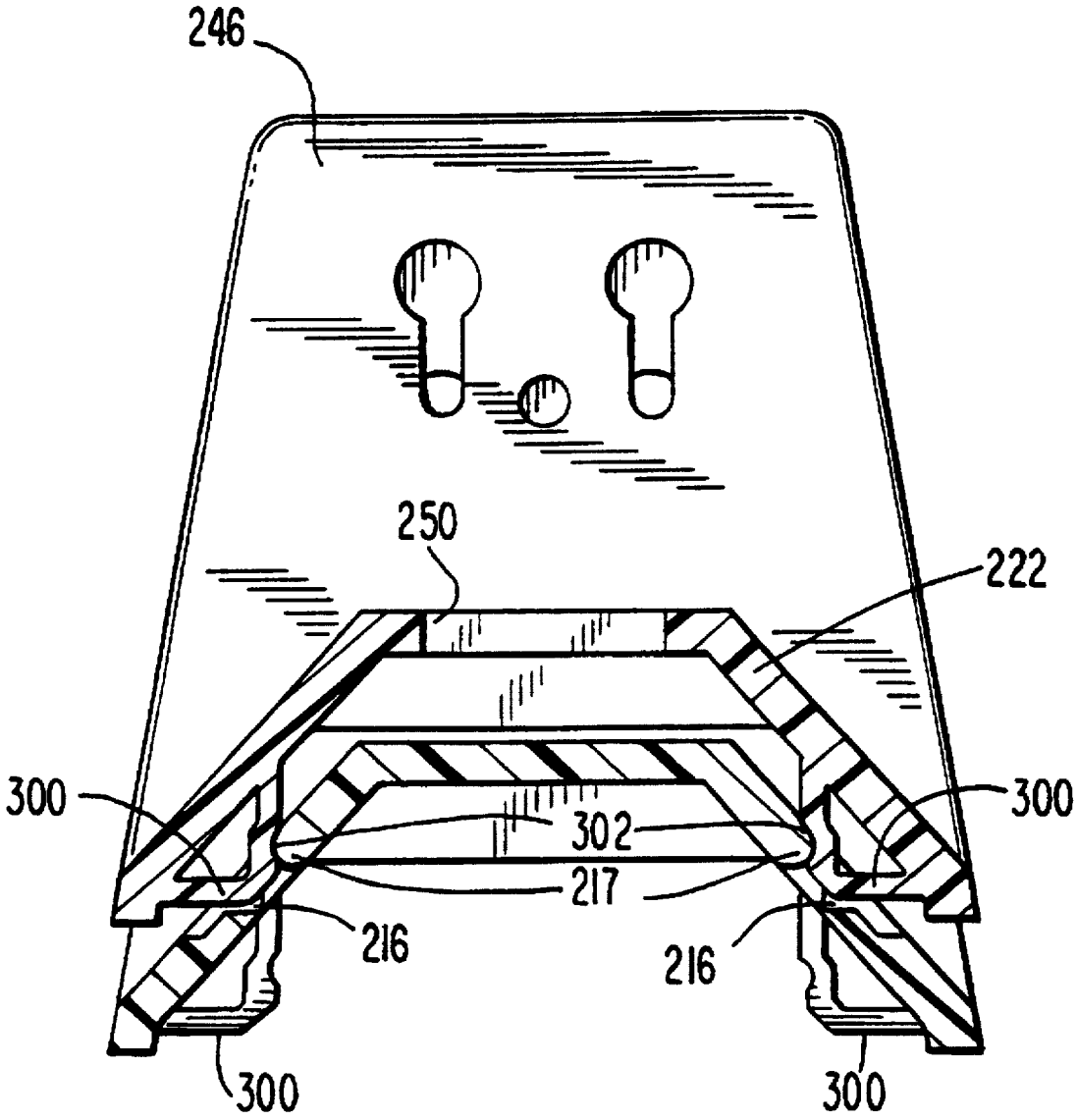
FIG. 9 is a sectional view taken along line 9—9 of FIG. 8 showing the roof catchboard bracket stacked with another such bracket.

Concerning nesting, each of brackets 200 includes recessed slots 216 on opposite sides of brace portion 222, the purpose of which will now be described also in connection with FIG. 9. Each opposing slot 216 includes a projecting portion 217 which is adapted to mate with L-shaped legs 300 on the underside of each of brackets 200. In this regard, the vertical walls defining the L-shaped legs include recessed portions 302 which releasably mate with projecting portions 217 so that, when nested, respective corresponding catchboard brackets can be releasably attached one on top of the other in staggered relationship. Pulling up through slot 250 on upper brackets 246, or exerting a lateral force from the underside will release the brackets from their respective nesting positions.

In this present embodiment, leg 240 is about 4" high, leg 211 is about 13" long, and the brace portion 222 of leg 211 is about 5" in length.

The present invention provides an improved roof catchboard bracket which is formed from a plastic material while providing enhanced features. The bracket is inexpensive to manufacture while providing the necessary support characteristics mandated by OSHA.

It will thus be seen that the objects set forth above, among those made apparent from the preceding description, are efficiently attained and, since certain changes may be made in the constructions set forth without departing from the spirit and scope of the invention, it is intended that all matter contained in the above description and shown in the accompanying drawings shall be interpreted as illustrative and not a limiting sense.

It is also to be understood that the following claims are intended to cover all of the generic and specific features of the invention herein described and all statements of the scope of the invention which, as a matter of language, might be said to fall therebetween.

What is claimed is:

1. A roof catchboard bracket for securing a catchboard to a roof, comprising an L-shaped bracket having a first leg adapted to be removably secured to a roof and a second leg adapted to be removably secured to a catchboard, and an integrally formed brace portion extending intermediate said first and second legs for bracing said second leg against said first leg, said L-shaped bracket being integrally formed from a plastic material, said brace portion including opposing slots to enable multiple brackets to be nested one upon the other.

2. The roof catchboard bracket as claimed in claim 1, wherein said plastic material is a polycarbonate plastic resin.

3. The roof catchboard bracket as claimed in claim 1, wherein said bracket includes locking means for releasably locking multiple brackets in said nested position.

4. The roof catchboard bracket as claimed in claim 3, wherein said bracket has an underside, said locking means including a tongue and groove arrangement, one of said tongue and groove being formed as part of said slots and the other of said tongue and groove being formed on the underside of said bracket.

5. The roof catchboard bracket as claimed in claim 1, wherein said first leg includes a pry chamfer area.

6. The roof catchboard bracket as claimed in claim 5, wherein said pry chamfer area is a recessed portion of said first leg.

7. A roof catchboard bracket for securing a catchboard to a roof, comprising an L-shaped bracket having a first leg with openings adapted to be nailed to a roof and a second leg having openings adapted to be nailed to a catchboard, said L-shaped bracket being integrally formed from a plastic material, and nesting means formed on said bracket for releasably coupling one said bracket to a second said bracket in stacked relation.

8. The roof catchboard bracket as claimed in claim 7, wherein said nesting means includes corresponding recessed portions and projections which releasably snap into said recessed portions.

9. The roof catchboard bracket as claimed in claim 8, wherein said bracket has an underside, said recessed portions being formed on the side walls of said bracket, said projections being formed on the underside of said bracket.

10. The roof catchboard bracket as claimed in claim 9, wherein said bracket includes grasping means for manually grasping said bracket to release it from nesting with a corresponding said bracket.

11. The roof catchboard bracket as claimed in claim 10, wherein said first leg includes an undercut which forms a pry chamfer region for removing said first leg from a roof when nailed thereto.

12. The roof catchboard bracket as claimed in claim 7, wherein said bracket when positioned for attachment on an inclined roof has said second leg facing the peak of the roof and the first leg extends downwardly therefrom.

13. The roof catchboard bracket as claimed in claim 12, wherein said second leg includes a surface facing away from said first leg, said catchboard being securable against said surface.

14. A roof catchboard bracket for attaching a catchboard to an inclined roof having a peak, comprising an L-shaped bracket having a first leg with first nail means for nailing said first leg to a roof and a second leg having nail means for nailing said second leg to a catchboard, said first leg having pry chamfer means for removing said bracket from a roof, said second leg having a surface facing away from said first leg and towards a peak of a roof, a catchboard being capable of being nailed to said surface so that a catchboard is closer to said peak than said second leg, brace means intermediate said first and second legs for bracing said second leg against said first leg, said brace means including nesting means for nesting one said bracket with another said bracket.

15. The roof catchboard bracket as claimed in claim 14, wherein said bracket is formed integrally from a plastic material.

* * * * *